US005687877A

United States Patent [19]

Smolen, Jr.

[11] Patent Number: 5,687,877

[45] Date of Patent: Nov. 18, 1997

[54] PUMP DISPENSER HAVING MOVEABLE OUTLET CHECK VALVE ELEMENT

[75] Inventor: Richard J. Smolen, Jr., Woodstock, Ill.

[73] Assignee: Owens-Illinois Closure Inc., Toledo, Ohio

[21] Appl. No.: 552,768

[22] Filed: Nov. 3, 1995

[51] Int. Cl.[6] ..... B67B 7/00

[52] U.S. Cl. ..... 222/1; 222/375; 222/383.1; 222/571; 239/333

[58] Field of Search ..... 222/380, 383.1, 222/375, 494, 571, 109, 1; 239/333

[56] References Cited

U.S. PATENT DOCUMENTS

| | | | |
|---|---|---|---|
| 3,843,030 | 10/1974 | Micallef . | |
| 3,995,774 | 12/1976 | Cooprider . | |
| 4,138,038 | 2/1979 | Grogan . | |
| 4,155,487 | 5/1979 | Blake . | |
| 4,161,288 | 7/1979 | McKinney . | |
| 4,204,614 | 5/1980 | Reeve . | |
| 4,227,650 | 10/1980 | McKinney . | |
| 4,527,594 | 7/1985 | Garneau . | |
| 4,527,741 | 7/1985 | Garneau . | |
| 4,669,664 | 6/1987 | Garneau | 239/333 X |
| 4,739,904 | 4/1988 | Spencer et al. | 222/109 |
| 5,181,658 | 1/1993 | Behar . | |
| 5,549,223 | 8/1996 | Hori | 222/380 X |

*Primary Examiner*—Gregory L. Huson

[57] ABSTRACT

A tulip-type check valve is housed in a cylindrical chamber, the length of which is greater than the check valve itself so that during the pressure stroke of the pump, the valve moves forward in its chamber and flexes to permit flow about its periphery. During the suction stroke, the valve closes and is drawn backward upstream in its chamber and there is a sucking back of liquid between the check valve and the orifice to obviate nozzle the drip.

12 Claims, 2 Drawing Sheets

PUMP DISPENSER HAVING MOVEABLE OUTLET CHECK VALVE ELEMENT

BACKGROUND OF THE INVENTION

This invention relates to pump dispensers in which a trigger or other actuator drives a piston or bellows-type pump. More specifically, the invention relates to the check valve downstream from the pump, between the pump and the discharge orifice. The outlet check valve herein includes a valve element which itself is axially moved forward and rearward in its chamber during pumping to effect a "suck back" of liquid from the orifice, preventing nozzle drip.

In the prior art there are a number of pump dispensers for dispensing liquid in the form of a spray, stream, or foam. Many of these dispensers include a piston-type pump, for instance, the McKinney U.S. Pat. Nos. 4,161,288 issued Jul. 17, 1979 and 4,227,650 issued Oct. 14, 1980. Others include a bellows pump exemplified by the Reeve U.S. Pat. No. 4,204,614 issued May 27, 1980; U.S. Pat. No. 4,138,038 issued Feb. 6, 1979 to Grogan; U.S. Pat. No. 4,155,487 issued May 22, 1979 to Blake, and the Cooprider et al U.S. Pat. No. 3,995,774 issued Dec. 7, 1976. In each case the pump in these dispensers has created a positive pressure in the flow passage during the reduction of the volume of the pump, and a negative pressure when the pump is enlarged. The pumping action has been controlled by a pair of check valves: one, the upstream check valve between the pump and the dip tube; and the other, the downstream check valve between the pump and the discharge orifice. It is the downstream check valve with which this invention in concerned.

It is a characteristic of the outlet check valves in the prior art that the valve element is permitted, after closing, little or no movement in its flow passage. Instead, it has been narrowly confined or totally blocked from movement. Examples of such confinement are disclosed in the Garneau U.S. Pat. Nos. 4,527,594 issued Jul. 9, 1985; 4,527,741 issued Jul. 9, 1985; and 4,669,664 issued Jun. 2, 1987.

The downstream check valve element in each of these patents is in the form of a tulip valve having a generally conical or frusto-conical body skirt with its apex directed upstream. The valve element is molded of plastic permitting the skirt to be resilient, its edge normally engaging and sealing against the cylindrical wall of its chamber, but upon downstream flow it flexes inward to permit passage of liquid past the check toward the orifice. On release of the actuator, for instance, a trigger, flow from the orifice toward the pump is blocked as the edges of the skirt re-engage the wall of the cylindrical chamber and the negative pressure created by the pump primes the pump, drawing liquid up through the dip tube past the upstream check.

When dispensing harmful liquids, it is important, after dispensing, that no leftover drops fall from the discharge orifice. For instance, if the liquid is bleach, a spilled drop or two could ruin a garment or if it is an oil-containing liquid, it could soil. The Applicant is aware of no downstream check valve arrangements which permit the "suck back" of liquid from the orifice to avoid this unwanted dribble.

SUMMARY OF THE INVENTION

Thus, under the present invention there is provided a tulip-type check valve which is housed in a cylindrical chamber, the length of which is longer than the check valve itself so that during the pressure stroke of the pump, the valve moves forward in its chamber and permits flow about its periphery and during the suction stroke the valve closes and is drawn backward upstream in its chamber and there is a sucking back of liquid between the check valve and the orifice to obviate nozzle drip.

Another prior patent has been noted. Behar U.S. Pat. No. 5,181,658 issued Jan. 26, 1993 discloses a cup-like check valve integral with a downstream core designed to cooperate with a nozzle in forming turbulent channels. Behar's valve element is shorter than its chamber and is, hence, able to move axially. However, Behar is concerned only with positive pressure as would be provided by a pressure chamber such as an aerosol can or pressure tank: there is no teaching of a negative pressure or suction present in the passage containing Behar's valve. Hence, the idea of drawing liquid back from the orifice is foreign to Behar.

BRIEF DESCRIPTION OF THE DRAWINGS

Other objects and features of the invention will be apparent to those skilled in the art from a study of the following specification and drawings, all of which disclose non-limiting forms of the invention. In the drawings.

DESCRIPTION OF THE PREFERRED EMBODIMENT

Figure 1:
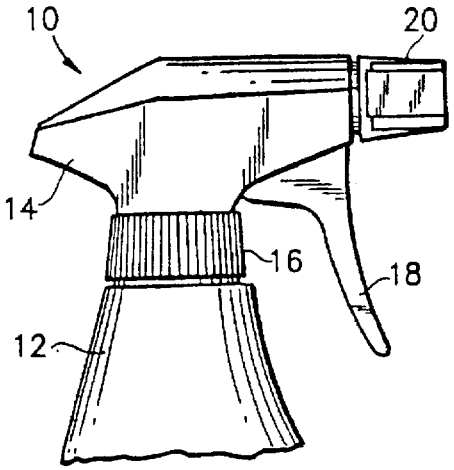
FIG. 1 is a fragmentary side elevation of a dispenser embodying the invention.

A liquid dispenser embodying the invention is generally designated 10 in FIG. 1. It comprises a container 12 on which is mounted a pump 14 secured by a screw cap 16. The pump is driven by a trigger 18 and the liquid is discharged through the nozzle 20.

Figure 2:
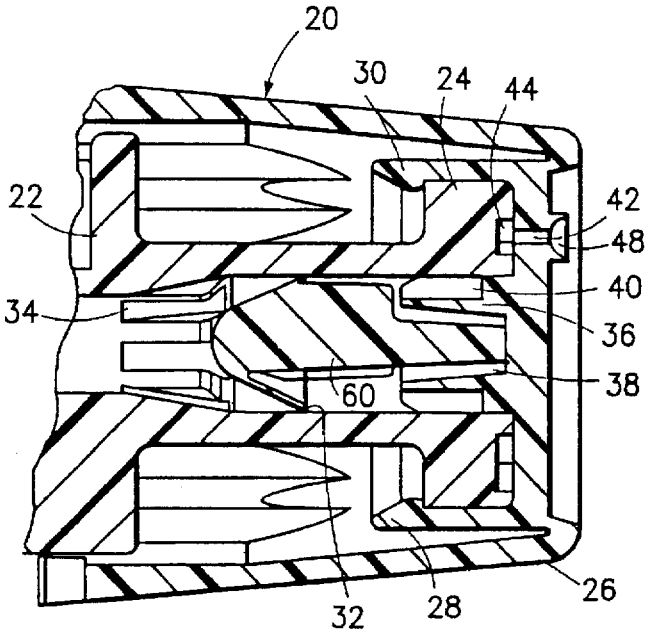
FIG. 2 is a greatly enlarged sectional view taken vertically through the axis of the nozzle as during a pressure stroke.
Figure 3:
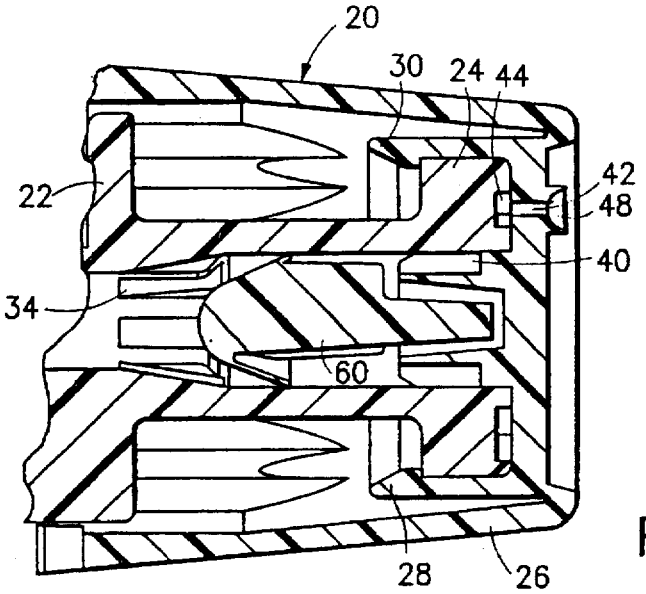
FIG. 3 is a sectional view similar to FIG. 2 showing the nozzle in a negative pressure or suction mode with the valve element traveling in the direction which is normally upstream.

Referring to FIG. 2, the nozzle comprises a tubular body 22 which has a forward cylindrical enlarged head 24. Fitting on the body is a nozzle cap 26 which is formed with a unitary inner annular wall 28, the wall being formed with an inward rib 30 which in installation snaps over the head 24, neatly rotatably holding the body and cap together.

The tubular body may be formed unitarily with the lower half of the pump housing as is conventional.

The bore in the body as shown is enlarged toward its forward end to form a valve chamber 32. At the beginning of the enlargement the body is formed with spaced inward ribs 34. Defining the front end of the chamber is an inward sleeve 36 unitary with the cap 26. Sleeve 36 fits inside the enlarged bore as shown and is formed with a central well 38. The sleeve 36 is reduced as at 40 to commence a passage from the chamber to the discharge orifice 42. The passage from the reduced area 40 to the orifice 42 is as well known in the art and fully disclosed in the U.S. Pat. No. 3,843,030 which issued Oct. 22, 1974 to Micallef. This description is incorporated herein. The passage may, if desired, include a swirl chamber 44.

Thus, during the pressure stroke of the pump, liquid will move downstream through the bore to the enlarged valve chamber 32 through the reduced area 40 to the swirl chamber 44 by passage means well known in the art and out the discharge orifice 42 in the form of a spray. If desired, the front of the nozzle cap 26 may be recessed as at 46 and formed with a drip-catching cup 48 as disclosed in the copending application Ser. No. 08/515,881 filed Aug. 16, 1995 of Contaxis and Smolen, assigned to my assignee. However, the invention will function without this feature.

Figure 4:
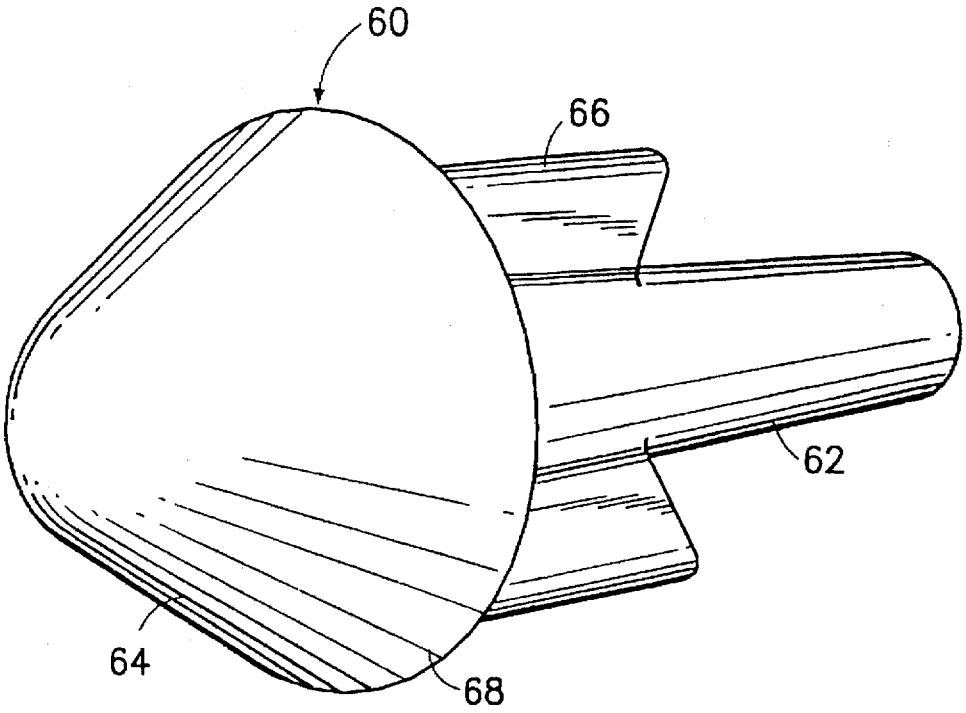
FIG. 4 is a greatly enlarged perspective view of the valve element.
Figure 5:
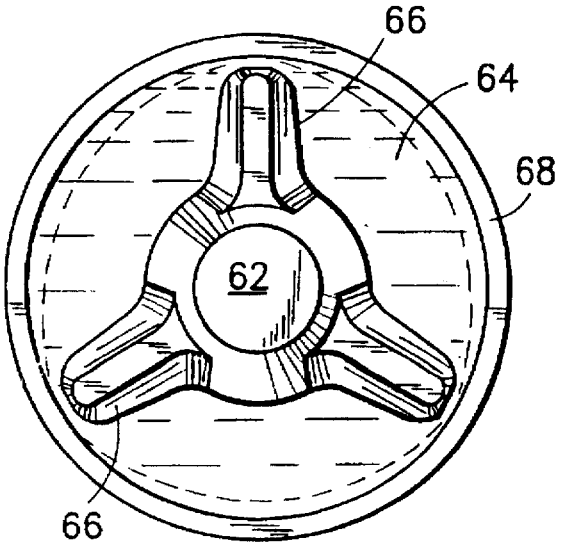
FIG. 5 is a rear end view of the valve element.

The valve element itself is designated 60 and is preferably molded from plastic. As shown in FIG. 4, it comprises a body having a tapered stem 62 which moves in the well 38 of the nozzle cap. The front end of the body is formed unitarily with the stem 62 with a conical head 64, the apex of the cone being rounded and directed upstream (FIG. 2). Also unitarily with the stem and head are radially extending fins 66 which serve to brace the conical head as shown in FIG. 5. The peripheral edge 68 of the head 64 normally engages the cylindrical wall of the chamber 32. Thus, the edge 68 in combination with the stem 62 riding in the well 38 serves to steady and guide the operation of the valve element.

As shown by dotted lines in FIG. 5, during the pressure stroke, liquid may pass about the periphery of the valve element as the edge 68 of the periphery flexes inward away from the wall of the chamber 32.

It is important to note that the distance between the bottom of the well 38 and the ribs 34 (or more precisely between the bottom of the well and the point where the ribs are engaged by the head 64) is greater than the length of the valve element from the downstream end of the stem 62 to that point of engagement on the head 64. In other words, the valve element 60 is free to move a considerable distance axially within its chamber 32.

In operation, during the pressure stroke the valve element 60 will move downstream until the stem 62 or the fins 66 bottom in the bottom of the well 38 or the upstream end of the sleeve 36 respectively. At this point, or even before, the peripheral edge 68 of the valve 60 will flex inward (dotted line in FIG. 5) to permit liquid to pass, as described, out the orifice 42. On the suction stroke the peripheral edge 68 will immediately resume its usual shape engaging the wall of the chamber 32 and thereafter the valve 60 will be drawn bodily upstream toward the pump until the head 64 engages the spaced ribs 34. With the upstream movement of the valve element 60 there is created downstream from the valve a suction, drawing the liquid in the downstream passage in an upstream direction and sucking back any liquid about to drip from the orifice 42.

This improvement in liquid dispenser nozzles effectively eliminates the possibility of dribble from the discharge orifice after pumping has been complete. It will be seen by those skilled in the art that the improvement, while still serving as an effective downstream check valve, thus provides an additional desirable feature.

It is contemplated that the valve element as shown in FIG. 4, when properly positioned and confined against axial movement, can also serve as an inlet valve for a pump system.

The invention described here may take a number of forms. It is not limited to the embodiment disclosed but is of a scope defined by the following claim language which may be broadened by an extension of the right to exclude others from making, using or selling the invention as is appropriate under the doctrine of equivalents.

What is claimed is:

1. In a hand-operated liquid dispenser comprising a. a container, b. a dispenser body secured on the container c. passage means in the body including 1) a dip tube extending into the container, 2) pump means adapted in operation to create negative and positive pressures in the passage means and connected to the dip tube, 3) an inlet check valve between the pump means and the dip tube, 4) a discharge orifice, 5) an outlet check valve between the pump means and the orifice, the improvement wherein the outlet check valve comprises an enlarged cylindrical portion of the passage means, the enlarged portion bounded by an annular shoulder at the commencement of the enlarged portion and stop means adjacent the orifice, and a unitary frusto-conical valve having a peripheral skirt resiliently directed downstream and engaging the walls of the enlarged cylindrical portion, and a central stem also extending downstream, the length of the enlarged cylindrical portion of the passage means being greater than the length of the frusto-conical valve, whereby the outlet check valve moves toward the stop means under positive pressure from the pump means and is drawn back toward the shoulder under negative pressure from the pump to effect a suck back of liquid between the outlet check valve and orifice.

2. A dispenser as claimed in claim 1 wherein the stop means is a front wall of a discharge nozzle and includes a central recess adapted to receive the stem.

3. A dispenser as claimed in claim 2 wherein the stem is tapered toward the downstream and the recess is correspondingly shaped.

4. A hand-operated liquid dispenser as claimed in claim 1 wherein the dispenser body is formed between the outlet check valve and the discharge orifice with a cylindrical enlarged head and the discharge orifice is formed in a nozzle cap defined by a rearwardly directed inner annular wall snugly receiving the enlarged head and terminating in an inward rib smaller in diameter than the enlarged head and serving to retain the cap on the head.

5. A hand-operated liquid dispenser as claimed in claim 4 wherein the cap is rotatable on the head.

6. An outlet check valve for a hand-operated liquid dispenser comprising a cylindrical-walled chamber having upstream and downstream boundaries and a unitary valve element disposed in the chamber and comprising a tapered central stem having an outward frusto-conical skirt at its upstream end resiliently engaging the cylindrical wall of the chamber, both the stem and skirt extending downstream, the chamber being longer than the valve element whereby the valve element, on occurrence of a negative pressure upstream from it, is adapted to move upstream in its chamber to draw downstream liquid upstream with it.

7. An outlet check valve as claimed in claim 6 wherein the stem is formed with a plurality of downstream radial fins.

8. An outlet check valve as claimed in claim 6 wherein the upstream end of the valve has a central rounded point.

9. An outlet check valve as claimed in claim 6 wherein the chamber is defined by a passage in a dispenser body having adjacent the downstream boundary a cylindrical enlarged head surrounding the passage, and a nozzle cap having a discharge orifice continuing the passage, the cap defined by a rearwardly directed inner annular wall snugly receiving the enlarged head and terminating in an inward rib smaller in diameter than the enlarged head and serving to retain the cap on the head.

10. An outlet check valve as claimed in claim 9 wherein the cap is rotatable on the head.

11. A check valve for a hand-operated liquid dispenser comprising a cylindrical-walled chamber having upstream and downstream boundaries and a unitary valve element of resilient material disposed in the chamber and comprising a tapered central stem and a frusto-conical skirt extending outward from one end of the stem, the skirt resiliently engaging the cylindrical wall of the chamber, both the stem and skirt entending downstream, the valve being formed with uniformly spaced fins extending radially outward from the stem and joining the skirt, and the frusto-conical skirt having a rounded nose on the opposite end from the stem.

12. The method of controlling the movement of liquid through an outlet check valve chamber having a cylindrical wall between a discharge orifice and a manually operated liquid pump wherein a valve element in the chamber has a downstream directed frusto-conical skirt engaging the wall and a central downstream stem, the chamber having a greater length than the valve element, the method including the steps of:

a. pumping the liquid downstream and thereby forcing the valve element to the downstream end of the chamber and b. then pumping the liquid upstream and thereby drawing the valve element to the upstream end of the chamber to aspirate liquid downstream from the valve element in an upstream direction to avoid undesired dribbling from the orifice.

* * * * *